US006186233B1

(12) United States Patent
Brunet

(10) Patent No.: US 6,186,233 B1
(45) Date of Patent: Feb. 13, 2001

(54) DOWN HOLE ASSEMBLY AND METHOD FOR FORMING A DOWN HOLE WINDOW AND AT LEAST ONE KEYWAY IN COMMUNICATION WITH THE DOWN HOLE WINDOW FOR USE IN MULTILATERAL WELLS

(75) Inventor: Charles G. Brunet, Houston, TX (US)

(73) Assignee: Weatherford Lamb, Inc., Houston, TX (US)

( * ) Notice: Under 35 U.S.C. 154(b), the term of this patent shall be extended for 0 days.

(21) Appl. No.: 09/201,391

(22) Filed: Nov. 30, 1998

(51) Int. Cl.[7] ..... E21B 29/06; E21B 7/06; E21B 7/08

(52) U.S. Cl. ..... 166/298; 166/50; 166/55; 166/117.6; 175/80; 175/81; 175/82

(58) Field of Search ..... 166/298, 55, 50, 166/117.6, 117.5; 175/81, 80, 82, 61

(56) References Cited

U.S. PATENT DOCUMENTS

| | | | | |
|---|---|---|---|---|
| 2,797,893 | * | 7/1957 | McCune et al. | 166/381 |
| 5,458,209 | * | 10/1995 | Hayes et al. | 175/61 |
| 5,474,126 | | 12/1995 | Lynde et al. . | |
| 5,484,021 | | 1/1996 | Hailey . | |
| 5,499,680 | | 3/1996 | Walter et al. . | |
| 5,499,682 | | 3/1996 | Sieber . | |
| 5,551,509 | | 9/1996 | Braddick . | |
| 5,592,991 | | 1/1997 | Lembcke et al. . | |
| 5,595,247 | | 1/1997 | Braddick . | |
| 5,771,972 | | 6/1998 | Dewey et al. . | |
| 5,791,417 | * | 8/1998 | Haugen et al. | 166/298 |
| 5,810,079 | | 9/1998 | Lynde et al. . | |

* cited by examiner

*Primary Examiner*—Hoang Dang
(74) *Attorney, Agent, or Firm*—Parks & Associates P.C.

(57) ABSTRACT

Down hole assembly and method for forming a longitudinal window and a key-way in communication with the longitudinal window used in drilling multi-lateral well bores and for entry and reentry thereafter comprising, a first milling drill bit for milling the longitudinal window, a first whip stock having a guide surface, and orientation and positioning members located on the first whip stock for orienting and positioning tools to be used in forming the key-way in communication with the longitudinal window. A guide surface member is provided on the first whip stock member for guiding the first milling drill bit for milling a longitudinal window. A housing member for slidable mating with the first whip stock having a second drill bit member mounted in the housing member is provided for forming a down hole orientation key-way in communication with the longitudinally milled window. A second guide surface member positioned along the center line of the one surface guide member on the first whip stock is provided for guiding the second drill bit to drill a down hole orientation key-way in communication with the longitudinal window. A second whip stock having a forming member for forming an up hole orientation key-way in communication with the longitudinally milled window is provided with at least one guide surface member on the second whip stock member for guiding the forming member for forming the up hole orientation key-way in communication with the longitudinal window.

22 Claims, 9 Drawing Sheets

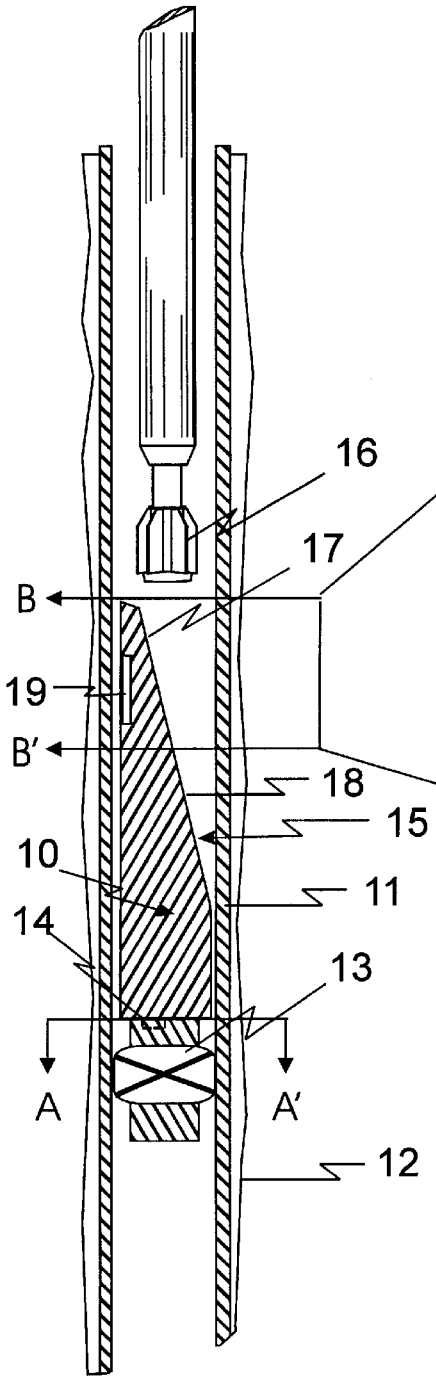
Fig. 1
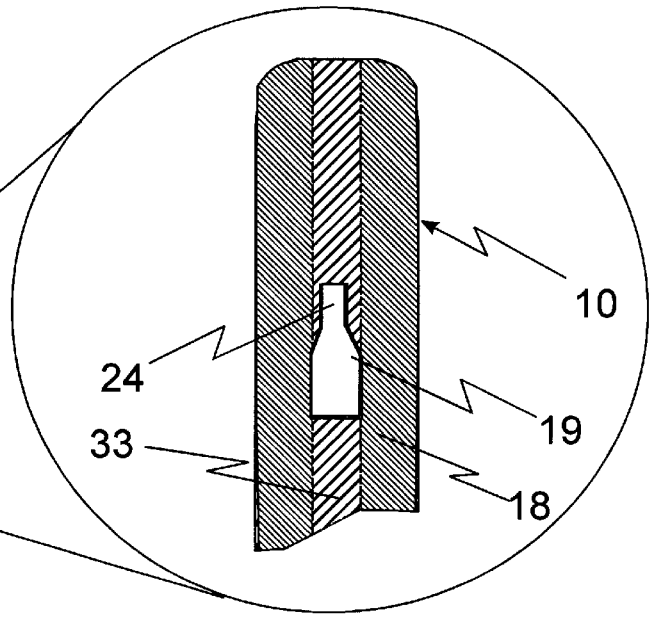
Fig. 1 B-B'
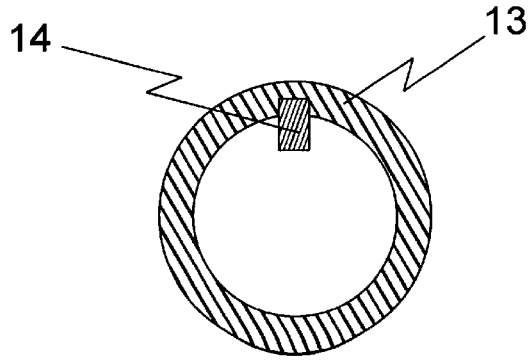
Fig. 1 A-A'

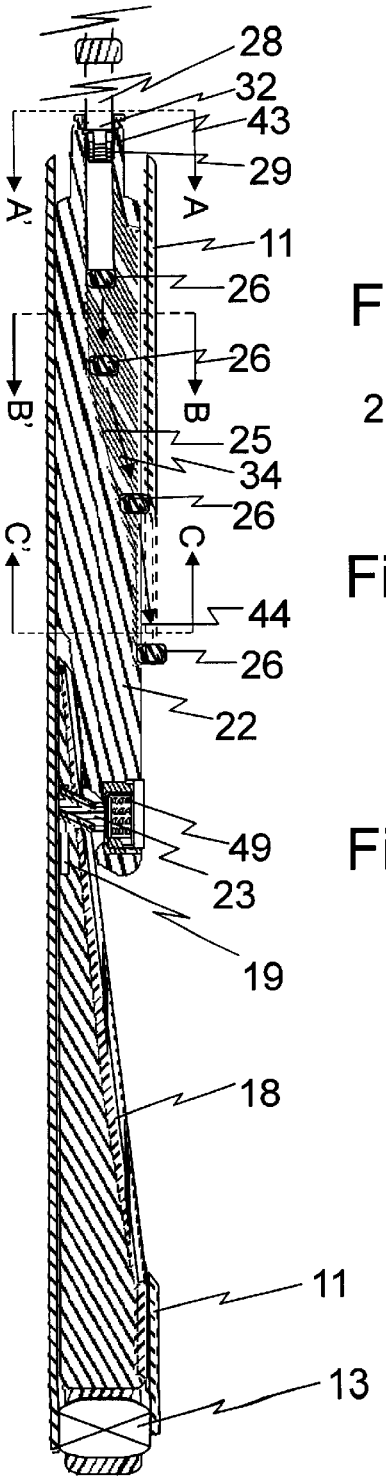
Fig. 4
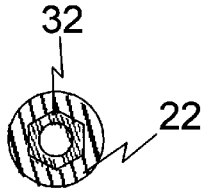
Fig. 4 A-A'
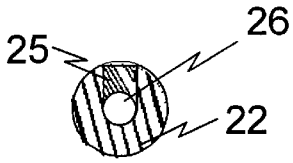
Fig. 4 B-B'
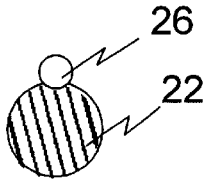
Fig. 4 C-C'
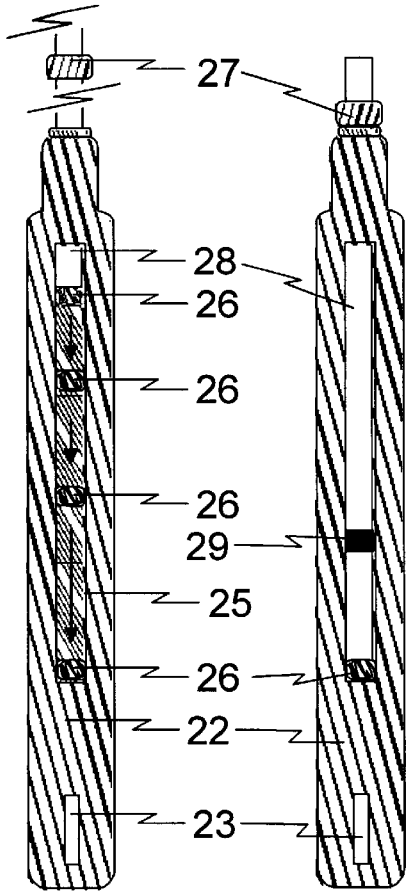
Fig. 5 Fig. 6

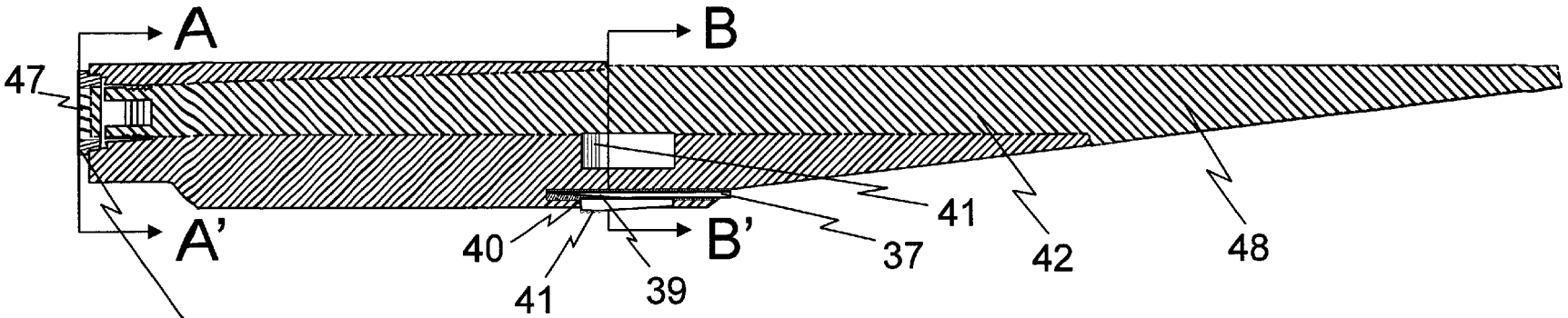
Fig. 17
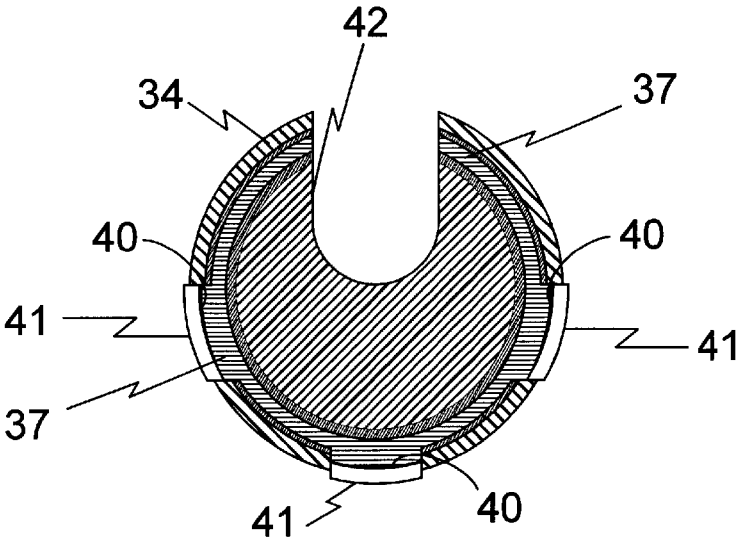
Fig. 17 B-B'
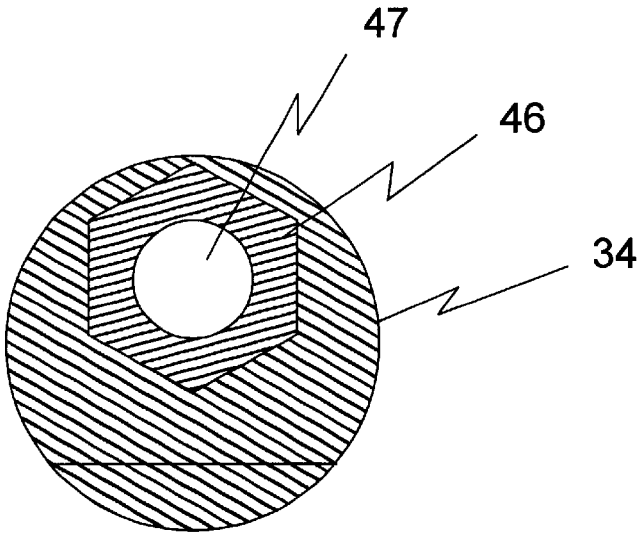
Fig. 17 A-A'

DOWN HOLE ASSEMBLY AND METHOD FOR FORMING A DOWN HOLE WINDOW AND AT LEAST ONE KEYWAY IN COMMUNICATION WITH THE DOWN HOLE WINDOW FOR USE IN MULTILATERAL WELLS

BACKGROUND OF THE INVENTION

This invention relates generally to apparatus and methods of using the apparatus for drilling lateral or multi-lateral wells from an existing well bore, for the purpose of producing more oil and gas from the subsurface formations and for entry and reentry into said multi-lateral wells after they have been completed and for orienting and placing packers and/or other completion equipment in relation to these laterals and multi laterals. Specifically this invention relates to novel and improved assemblies and methods for the down hole milling of down hole windows and key-ways in communication with the down hole window for use in drilling and reentry of multilateral wells installation and completion of lateral well bores emanating from a main casing or a tubular walled member which may be vertical, deviated or horizontal and their entry or reentry.

Since it's inception horizontal drilling has offered a more efficient and cost effective means to produce oil and gas. This is primarily due to the advantage that horizontal drilling affords of economically exposing more of the hydrocarbon bearing reservoir to the wellbore. The recent introduction of multilateral drilling in which multiple horizontal or near horizontal wells are installed from a single vertical wellbore has extended the advantages of horizontal drilling while reducing the cost per foot of subsurface reservoir exposed, as well as reducing the amount of surface facilities required to develop an oil field. This has led to increased hydrocarbon production from multilateral wells. Until recently individual laterals were not cased or tied back to the main production casing. This meant that it was difficult or impossible to reenter these laterals in the event that workovers or stimulation was required.

The technology now exists to drill, tie back and complete multiple laterals in vertical, deviated, directional or horizontal wells either at the time the well is drilled or at a later time in the life of the well. More than one lateral can now be drilled, i.e., "Kicked Off" at the same elevation of the main casing in a well, and there is no limit as to how many laterals can be installed from a single main casing. However this has made the need for accurate placement of the positioning and drilling tools a crucial part of the drilling operation to achieve the desired results. The industry has relied on the accurate placement of "whipstocks", which are used to deflect the drill bit from the main casing at the desired location in a well to have a lateral drilled therein. In some cases a liner may be installed in the lateral and tied back to the main casing. Alternatively the laterals may be left unlined. In either case the whipstock is generally removed from the position of the drilled lateral, thus taking away the means to position or located the point of entry into the lateral well drilled unless some other positioning device is provided. As laterals in wells can be installed at the time the well is drilled or may be added at a future time if it is determined that incremental reservoir exposure is needed and it is determined that additional reservoirs may be accessed from the same wellbore, thus the industry has placed increasing importance on being able to selectively re-enter these laterals for workover operations, which makes accuracy of location of the lateral in the well bore important.

The equipment currently available in the industry is limited in allowing access to these laterals. Multilateral systems that employ premilled windows generally have a remotely located slots that are engaged by spring loaded lugs located on the whipstock which insure correct orientation to the window opening. These slots may be either tubular or rectangular in nature, and are located below the window opening. However these slots are limited to new wells as they must be installed in the casing string prior to the time that the casing is run. Also to reenter an existing well the general approach has been to set a packer below each window. This packer is used to land, anchor and orient the whipstock for both the drilling as well as any future reentry of the lateral for workover operations in the future. However allowing this packer to remain in the well restricts the ability to access the wellbore below this point. Alternatively removing the packer eliminates the possibility of reentering the lateral at a later date.

More recent prior system have been introduced to allow some type of reentry or detection device to land and anchor at the bottom of the window to allow the reentry of the lateral for workover purposes. Some drawbacks of these systems is their inherent inaccuracies in placement and unreliability in securing the deflection apparatus involved due to the inexact nature of the window which are milled downhole. These systems have been difficult to use because of the jagged, rough edges and metal shavings produced by the down hole milling of the window and can prevent the proper setting and alignment of such reentry tools. Up to this time all reentry systems have relied almost solely on using the raw cut bottom portion of the milled window to land and orient reentry devices.

Thus while there has been an increase in usage of the more advanced systems for lateral or multi-lateral well drilling in new wells, their use in existing wells has lagged behind. Though the number of multi laterals being drilled in existing wells has also increased, there has also been an increase in the problems associated with their installation because they are being used in more and varied well conditions and at more extreme angles of deviation from the vertical well bore than ever before. While there have been developed, many techniques to solve some of these problems they have only resulted in creating other and different problems. One of the most basic is providing a simple and universal assembly or assemblies and method or methods which can be used for both drilling and completion and also entry and reentry at a later date of a previously drilled well, even if that well has been drilled many years before because the cost are too great to pull or mill away the casing and set new casing with premilled window for drilling the desired multilateral wells needed in these wells.

The prior art has many approaches to solve this problem but most of them have required the mounting of keys, key-ways, slots, and packers permanently on the inside of the well bore and casing. While these approaches have had some success they have limited use because they reduce the access to some producing zones because they often project inwardly to the well , or in the case of an old well use a packer, which restricts access below this point in the well casing. Any system which restricts the operating diameter of the well bore also restrict the ability to operate other tools in the well passed the area were a multilateral has already been drilled. Due to the large forces used in wells created by the pipe and tools being moved up and down, these internal projections are subject to being damaged or destroyed by tools working in the casing, which would render the projections useless for their intended purpose. This is especially true for reentry of a drilled multilateral at a later date for additional workover of the multilateral. Thus the expense of the first multilateral well drilled could be completely lost, as well as access to that oil bearing strata without undertaking great additional expense.

Clearly multi-lateral drilling assemblies which have come under use in deeper and more complex older wells are more likely to have problems associated with retrieving and manipulating them in the well bores and successfully completing a multilateral. This is because the record keeping associated with these wells may have been lost or even if it exists, may not be as accurate as the records which are kept today. It is also more likely that numerous reentries or production operations undertaken on these wells over the years may have led to damage of the casing in certain areas.

In older well at greater depths a yet further problem is finding the exact location of the window which has been milled downhole and to properly orient the completion and production equipment to put that multilateral well in service. For example in a well have a depth of 10,000 feet, the spring in the drill string running tools can have several feet of movement or "slack" between the surface and downhole window. Further these well bores may not be straight down but instead contain sections, or "Cork Screws" in them from the previous drilling operations. The prior art has used spring loaded keys, for locating and orienting operations related to the geological formations for these lateral well bores. However many of these keys were equipped with multiple sets of keys which must mate with mounted key-receivers which were located in the main casing as part of the multilateral drilling process. This mating process could be a relatively complex arrangement and require diligence and accuracy in finding the correct key system. Also it required a very detailed and complicated record keeping procedure for any future work which might be done in the well for the future. Also as the various key-receivers for each well could be different it required the maintenance of a large inventory of each key system and this problem is growing as the number of such systems is increasing around the world.

In many of the prior art spring loaded key systems, the keys while easy to engage once the key was directly over the key hole or key way, these key holes and ways are normally of relatively small square area and a significant amount of time could be required for manipulating the drill string and tools to find the exact position to allow the key to spring out and mate with the key holes and key ways so that further work could be do. In most cases the keys had to hit key holes and ways with target areas measured in 25 to 50 square inches.

As the prior art often dealt with existing wells, which often used small target areas and which by nature are somewhat messy and unclean, these target areas can be completely fill up with metal shavings from earlier milling operations or formation cuttings which were generated when the lateral was drilled. In this case the spring loaded key would not have a space into which it could engage, with the corresponding problems of not being able to set other tools without additional work and runs back into the hole to clear the key hole or key ways.

Yet another problem in the prior art is the reentry of the at least one multi-lateral well once it has been drilled and completed, without leaving the whip stock and other orientation devices in the well. Leaving any of this equipment in the well would block other formations from having multi-lateral wells drilled in them, which is often not acceptable. Unfortunately removing this equipment left few if any means of identifying the entrance to the at least one multi-lateral well bore.

A further problem was even finding the down hole milled window because if the well is an older one many of the keys or indicators which were originally attached or fixed in the casing or tubular walls have been damaged or destroyed by other work that has occurred in the well since the drilling of the at least one multi-lateral well.

Also in the prior art the ability to reenter a well is many times totally dependant on the accuracy of the historical records kept on a well and the older the well the less likely the well records were likely to be available for use in the reentry process which rendered reentry either impossible or very expensive.

Further in the prior art the accuracy of reentry was not very good and while reentry was made it was not very accurately done with the corresponding wear and tear on the windows and key systems used, with a corresponding shortening of the life of the downhole milled window and it's keying system of what ever kind.

OBJECT OF THE INVENTION

It is an object of this invention to provide apparatus and methods of using the apparatus for down hole milling longitudinal windows and at least one key-way in communication with the longitudinal windows in existing wells for the purpose of drilling lateral or multi-lateral wells from a vertical well or tubular wall. The ultimate purpose is for producing more oil and gas from the subsurface formations by the use of this improved apparatus and method of this invention and have a higher degree of success in all wells where it is used. This includes wells where this apparatus and method are utilized in either new or old wells or where reentry is needed in an older well using this apparatus and method for additional work in the lateral or multi-lateral or where completion equipment must be accurately placed or oriented with relation to one or more laterals or multi laterals or used in any combination there of to achieve the purpose of enhanced production of the wells.

It is also an object of this invention to mill at least one window and at least one key-way in communication with the at least one window while the casing or tubular walls of a well are in place in the well bore whether as the result of a new well or an old well.

A further object to this invention is to mill or drill a window and at least one key-way in communication which allows for reentry into the laterals in the event that a workover or stimulation became necessary at the time of drilling or at a later date.

Yet another object of this invention is to be able to find the window and at least one key-way with out the use of a whip stock being reintroduced back into the well to achieve reentry back into the lateral.

It is also an object of this invention to be able to reenter a lateral well bore from the casing or tubular walls whether or not the laterals are tied back, so that selective reentry of these laterals for workover operations can be performed.

Also an object of this invention is to provide reentry into the lateral of a well with out the use of or introduction of some type of deflection device being landed and anchor at the bottom of the main window to allow and effect the reentry of the lateral for workover or any other purposes.

Clearly to those skilled in the art the further objective of achieving inherent accuracies in placement and reliability in reentry will be appreciated and understood, especially achieving these objectives in a down hole milled environment.

Another object of this invention is the achieving of accuracy of placement of reentry tools in the environment of jagged, rough edged down hole milled windows with metal shavings produced by the drilling of the window for the purpose of setting the reentry tools exactly in the multilateral using either one or both the bottom portions of the window with a down hole key-way or using the up hole key-way portion of the window having both key-ways milled in communication with the window.

It is a further object of this invention to provide a simple and universal assembly and method which can be used for both drilling and completion of and also entry and reentry at a late date of a previously drilled well, even if the well has been drilled many years before using up and down hole key-ways milled in place.

A further object of this invention is to provide a down hole milled window and at least one key-way in communication with the window which does not leave packers, keys, slots or other equipment in the well bore and casing after the lateral is drilled, and which therefore does not reduce the inside diameter of the well bore or in some way restrict access below the point where the multilateral well was drilled off the main well bore or tubular wall.

Thus it is an object of this invention to provide a down hole milled window with a key-way in communication with the window which is in the wall of the casing or tubular wall of the well and is out of the way of equipment and tools which move up and down the well bore or the tubular walls while other strata are being drilled or worked over.

Yet another object of this invention is to provide a down hole milled window and key-way in communication with the window on which no complicated historical well data is required for entry or reentry.

It is an object of this invention to provide a key-way which is milled down hole and which is in communication with the window to provide a large open target area, to whit the whole area of the window and key-way, for receiving the key of the reentry tool or workover tool and then guiding the key into the at least one key-way with out the need for excessive diligence and accuracy in finding the key way or system of keys.

Also an object of this invention is to provide at least one down hole and/or one up hole keyway in communication with the window for use singularly or in combination with reentry tool, completion tools, workover tools etc. in and for multilateral well.

Yet further and additional benefits and improvements of the invention will be appreciated by others skilled in the art and those advantages and benefits of the invention will become apparent to those skilled in the art upon a reading and understanding of the following detailed description.

BRIEF DESCRIPTION OF THE DRAWINGS

This invention may be practiced in certain physical forms and arrangements of the parts herein described, but at least one preferred embodiment of which will be described in detail in the specification and illustrated in the accompanying drawings which form a part hereof.

FIG. 1 is a cross section side view of a first milling drill bit, orientation and position member, and a first whipstock set in a casing in preparation for the drilling of one longitudinal window in a well.

FIG. 1 B–B' is a top view of one embodiment of an orientating and positioning member taken through B–B' of FIG. 1.

FIG. 1 A–A' is a cross sectional top view of one embodiment of an orientation member positioned on a packer in this embodiment for orientation of the first whip stock, one guide surface and orientation and positioning member in a desired direction.

FIG. 4 is a cross sectional side view of the first whip stock and a second whip stock member mated with the first whip stock showing the second milling drill bit representationally moved from a starting position to a finish position for drilling an up hole orientation key-way in communication with the longitudinally milled window.

FIG. 4 A–A' is a cross sectional view through the locking mechanism for attaching the second milling drill bit member to the second whip stock member.

FIG. 4 B–B' is a cross sectional view through the second whip stock member showing the second milling drill bit member in the guide surface on the second whip stock member being guided by the guide surface on the second whip stock member for milling an up hole orientation key-way in communication with the longitudinal window.

FIG. 4 C–C' is a cross sectional view through the second whip stock member showing the second milling drill bit member in the guide surface on the second whip stock member being guided by the guide surface on the second whip stock member as it completes the milling of an up hole orientation key-way in communication with the longitudinal window.

FIG. 5 is a top cross sectional view of the second whip stock member showing the second milling drill bit member in it's starting position in the second whip stock member and it's representational movement from the starting position to the finish position in the milling of an up hole orientation key-way in communication with the longitudinal window.

FIG. 6 is a top cross sectional view of the second whip stock member showing the second milling drill bit member in it's finish position in the second whip stock member and it's position in the finish position in the milling of an up hole orientation key-way in communication with the longitudinal window.

FIG. 10 E–E' is a cross sectional view taken through the first whip stock member having a first and second guide surface shown in FIG. 10 at E–E'.

FIG. 10 D–D' is a cross sectional view taken through the first whip stock member having a first and second guide surface shown in FIG. 10 at D–D'.

FIG. 10 C–C' is a cross sectional view taken through the first whip stock member having a first and second guide surface shown in FIG. 10 at C–C'.

FIG. 17 is a side cross section view of the milling drill bit housing, with out the second drill bit member positioned therein, to show the positioning and guiding features of the milling drill bit housing.

FIG. 17 A–A' is a cross section through FIG. 17 at the locking nut for holding an advancing drilling shaft.

FIG. 17 B–B' is a cross section through FIG. 17 at the mid point of the milling drill bit housing showing the leaf griping members and the side guide surfaces of the milling drill bit housing which support the second drill bit.

Figure 2:
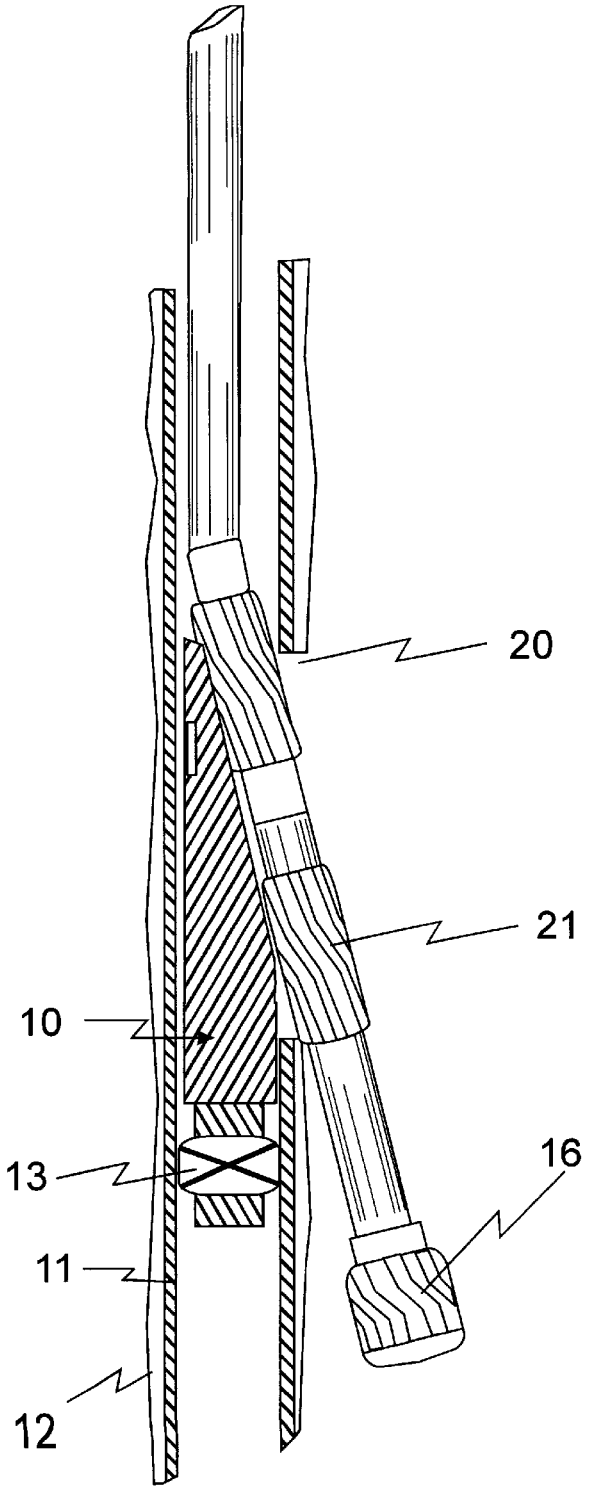
FIG. 2 is a cross sectional side view of the first milling drill bit milling a longitudinal window downhole as the first milling drill bit is deflected off the whip stock member.

While the invention will be described in connection with the preferred embodiment, it will be understood that it is not intended to limit the invention to that embodiment. On the contrary, it is intended to cover all alternative, modifications and equivalents as may be included with the spirit of the invention as defined in the appended claims.

DESCRIPTION OF PREFERRED EMBODIMENT

The purpose of this invention is for providing an assembly and method for down hole milling of at least one longitudinal window and at least one orientation key-way in communication with the at least one longitudinal window and for supporting an assembly and performing methods to drill at least one multi-lateral well and for supporting an assembly and performing a method for reentry into the at least one multi-lateral well drilled after it is drilled.

Referring now to FIG. 1 one embodiment of this invention using a first whip stock which is generally shown at reference number 10 is positioned in a tubular wall or casing 11 which is in a well bore 12. The first whip stock 10 is positioned in the tubular wall or casing 11 on to a fixed or removable platform 13 which in some embodiments will be a packer. The first whip stock 10 is oriented, in this embodiment, on the removable platform 13 by an orientation member 14 which is mounted in a known orientation on the removable platform 13, which thus allow the first whip stock 10 to be positioned in a desired direction relative to the known orientation of the orientation member 14. The preferred orientation of the first whip stock 10, as those skilled in the art will appreciate, is an orientation which sets the first whip stock 10 in a position for the orientation and positioning members generally referred to as 15 located on the first whip stock 10 to be used in orientating, guiding, securing, and deflecting a drill bit in a desired direction for milling a longitudinal window in the tubular walls or casing 11 through which a multi-lateral well can be drilled and for orientating, guiding, securing, and deflecting a drill bit for drilling at least one orientation key-way in communication with the longitudinal window.

Figure 3:
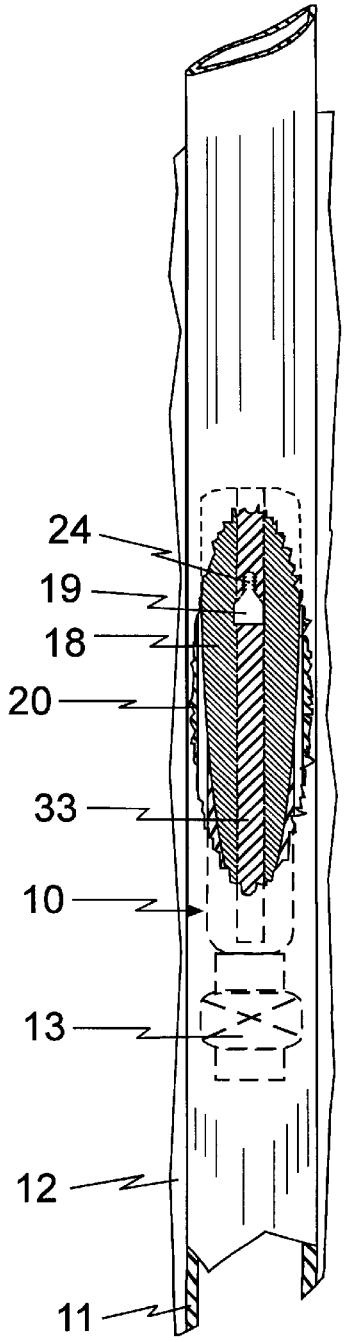
FIG. 3 is a face on view of the milled longitudinal window with the first milling drill bit removed and the first whip stock shown in both partial section and hidden lines in place in the casing after the milling of the longitudinal window.
Figure 7:
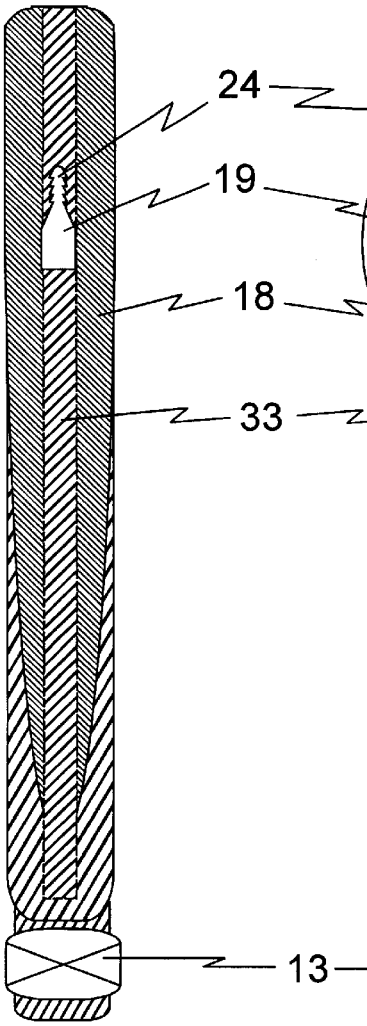
FIG. 7 is a cross sectional view of an embodiment of a first whip stock member having a first guide surface and second guide surface positioned along the center line of said at least one guide surface on the first whip stock member for guiding a second drill bit member to drill a down hole orientation key-way in communication with the longitudinal window.

Once the first whip stock 10 is oriented relative to the orientation member 14 on the removable platform 13 and the removable platform 13 is set in the tubular walls or casing 11 of the well, then the milling of the longitudinal window may commence. This is achieved by running a first milling drill bit member 16 down the tubular walls or casing 11 and striking the first whip stock 10 which deflects the first milling drill bit member 16 into the wall of the tubular walls or casing 11 and drills through it to form a longitudinal window 20 in the tubular wall or casing 11 as shown in FIG. 2. In combination with the first milling drill bit member 16, additional milling members called watermelon milling bits 21 may be used which results in the formation of at least one longitudinal window 20, as best seen in FIG. 3.

It will be understood by those skilled in the art that the orientation and positioning members, generally shown as 15, located on the first whip stock member 10 may be used in combination with tools which work together to drill and mill the longitudinal window 20 in the tubular walls or casing 11, and also orientation key-ways, but the orientation and positioning members 15 must be set accurately to allow the achievement of the accurate milling or drilling of the at least one orientation key-way in communication with the longitudinal window 20 in the tubular walls or casing 11. Thus in the embodiment shown in FIG. 1 the orientation and positioning members 15 are the inclined surface 17 which has in this embodiment at least one guide surface 18 and second guide surface 33 thereon as seen in FIG. 1 B–B'. Also as part of the orientation and positioning members 15, at least in this embodiment a securing member, is shown as a key receiving area 19, which is for receiving a key from other tools to be used in the orientating and positioning process of milling at least one orientation key-way in communication with the longitudinal window but will be discussed later herein.

Figure 8:
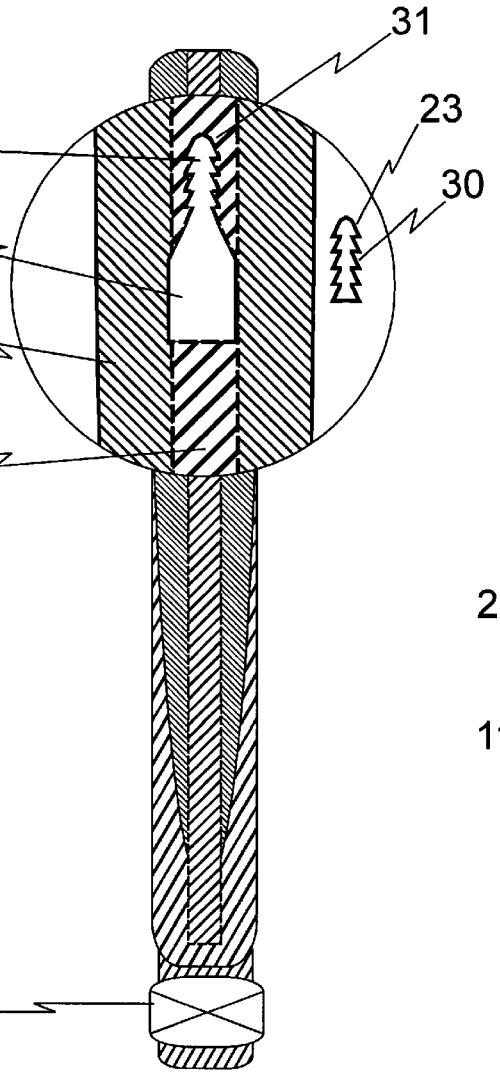
FIG. 8 is a cross sectional view of an embodiment of the first whip stock member with the orientation and positioning member being enlarged to show the griping surfaces therein and representationally showing the mating surfaces of a key member, with the full key member not shown.

For example in the case where an up hole orientation key-way in communication with the longitudinal window 20 is desired, a second whip stock member 22 having a key member 23 connected to the second whip stock member 22 is run into the tubular walls or casing 11 until the key member 23 engages the key receiving area 19 on the first whip stock 10. The key member 23 is a spring loaded with a spring 49 such that upon being passed over the key receiving area 19 on the first whip stock 10, the key member 23 would pop into the key receiving area 19 and allow the second whip stock 22 to be locked into place once the key member 23 is pulled upward into a key locking area 24 which is in communication with the key receiving area 19. Once locked in place the second whip stock member 22 is accurately positioned on the first whip stock 10 to be in both the proper orientation and location for the process of milling an up hole orientation key-way which will be in communication with the longitudinal window 20. In some embodiments the key member 23 has collet like grabbing surfaces 30 there along and the key locking area 24 has corresponding collet like grabbing surfaces 31 there along such that when the key member 23 and with it's collet like grabbing surfaces 30 coming into engagement with the corresponding collet like grabbing surfaces 31 on the key locking area 24 a positive locking of the key member 23 and the key locking area 24 occur. This locking arrangement is best shown in FIG. 8. This locking in this fashion as those skilled in the art will appreciate can be controlled so that downward force may be used to provide signals or other activity in this orientation key-way milling process with out disengaging the key member 23 and the key locking area 24, but that upon providing a force of a greater order of magnitude the key member 23 and key locking area 24 may be disengaged and allowed to have a controlled separation for the removal of the second whipstock member 22 for the first whip stock member 10 for other operations in the tubular wall or casing. Also the engagement of the key member 23 and the key locking area 24 into the key receiving area 19 would be so secure as to allow the second whip stock member 22 to be used as a retrieving tool to retrieve the first whip stock 10 with out having to have a special run into the well thus eliminating the expense of a additional run into the well in the multilateral process.

The second whip stock member 22 has at least one guide surface 25 and a second milling drill bit member 26 operationally connected to the second whip stock member 22 for drilling an up hole orientation key-way in communication with said longitudinally milled window 20. This at least one guide surface 25 is in this embodiment positioned along the center line of the second whip stock member 22, as can best be seen in FIGS. 5 & 6, in alignment with the center line of the longitudinal window 20. In this embodiment the key member 23 is in direct alignment with the second milling drill bit member 26 but on the opposite side of the second whip stock member 22, thus once the key member 23 is in place in the key locking area 24 the one guide surface 25 on the second whip stock 22 is perfectly aligned with the center line of the longitudinal window 20. This center line alignment can also be seen from the position of the key locking area 24 and key receiving area 19 on the first whip stock 10, as seen in FIG. 3.

The one guide surface 25 on the second whip stock 22, while set to be center aligned with the center line of the longitudinal window 20, as shown in FIGS. 5 & 6, in one orientation, it is designed to start approximately on the center line on one end 43 of the second whip stock 22, as best shown in FIG. 4 A–A', and progress out of center alignment toward the other end 44 of the second whip stock 22, as shown in FIG. 4 C–C'. This movement out of alignment continues until it finally reaches a position that would place the second milling drill bit member 26 in a position to mill a full gauge up hole orientation key-way in communication with the longitudinal window 20.

Figure 9:
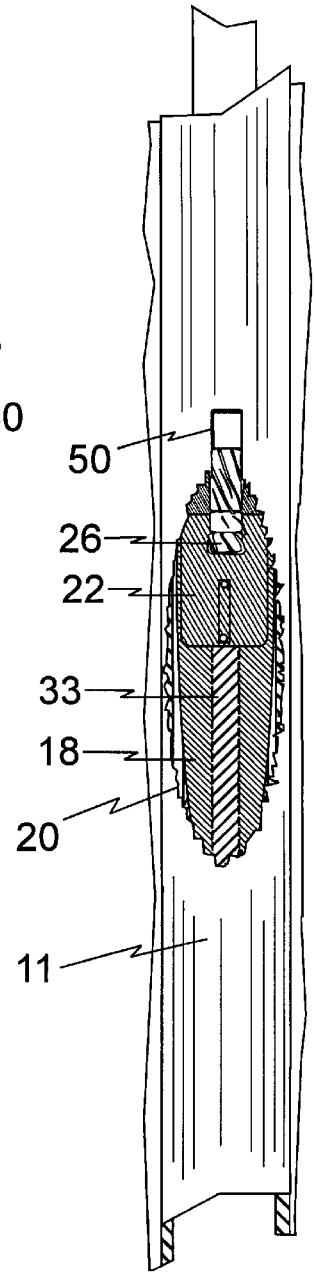
FIG. 9 is a face view of the longitudinal window with a completed up hole orientation key-way milled therein and showing the first whip stock means and second whip stock means mated and the second milling drill bit member in it's finished position.
Figures 10, 11, 12:
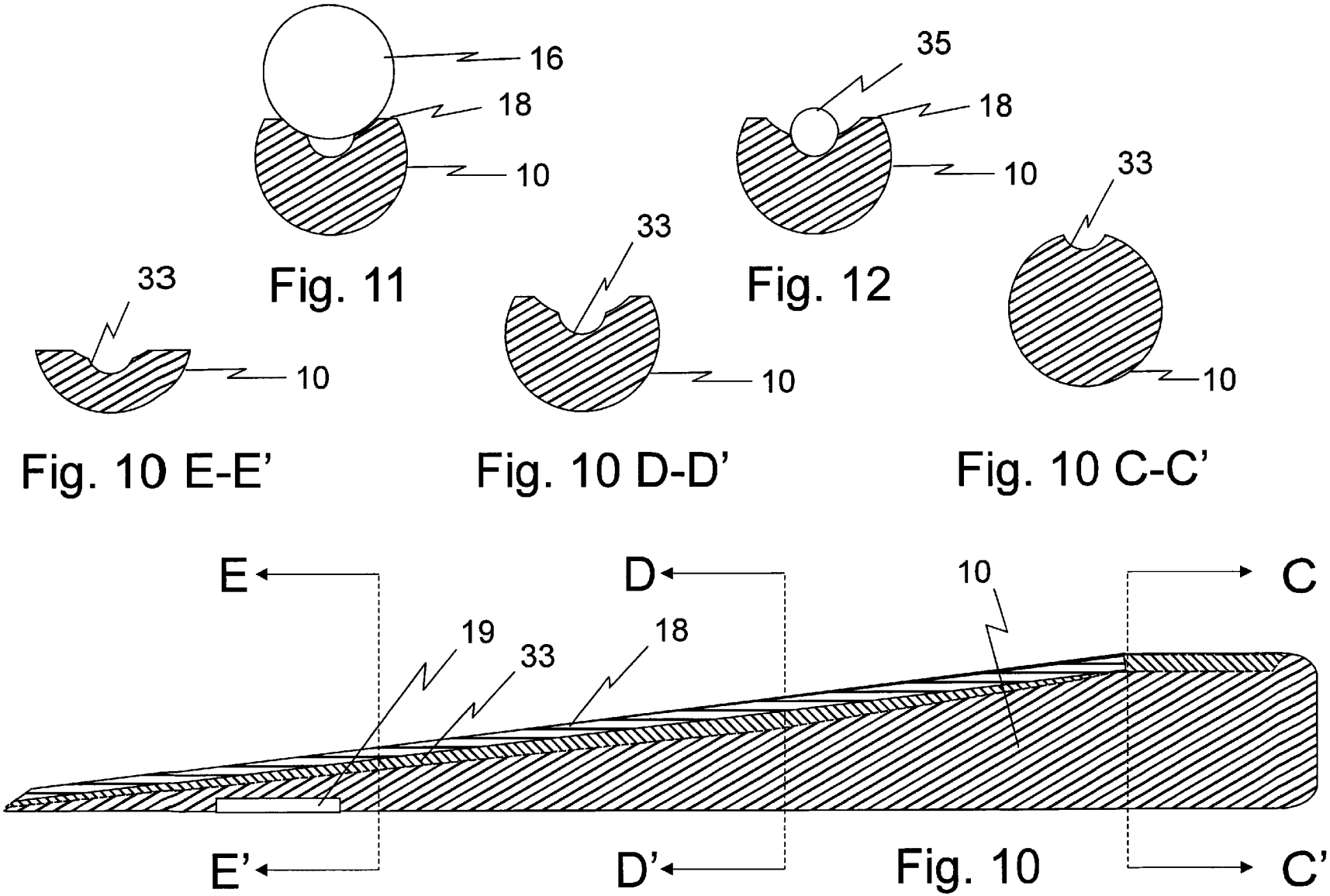
FIG. 10. is a side cross sectional view of a first whip stock member having a first and second guide surface shown.
FIG. 11 is a cross section view of the first whip stock member with a representational first milling drill bit member shown as it would progress down the first guide surface over the second guide surface positioned along the center line of the first guide surface on the first whip stock member for milling a longitudinal window.
FIG. 12. is a cross section view of the first whip stock member with a representational second milling drill bit member shown as it would progress down the second guide surface in the second guide surface positioned along the center line of the first guide surface on the first whip stock member for milling a down hole orientation key-way in communication with the longitudinally window.

This second milling drill bit member 26, whether it would be powered by a mud motor, rotary drill shaft or other power means, would have an advancing shaft 28 which is designed push the second milling drill bit member 26 down hole to follow in the one guide surface 25 from its approximate starting position at FIG. 4 A–A' and progress along the one guide surface 25 guided by the one guide surface 25 at FIG. 4 B–B' until the one guide surface 25 in conjunction with the second milling drill bit member 26 being advanced forward forces the second milling drill bit member 26 to engage the tubular walls or casing 11 and mill a up hole key-way 50 in communication with the longitudinal window 20. This can be seen by the representational positions in FIGS. 4, 5, & 6. In FIG. 6 the second milling drill bit member 26 would have been advanced it's full distance which would finish the milling of the up hole orientation key-way 50 and put the up hole orientation key-way 50 in communication with the longitudinal window 20 as best seen in FIG. 9. In FIG. 5 it can be seen that a "no go" member 27 is connected to the advancing shaft member 28, in this embodiment above or up hole of the second whip stock 22 to stop the advance of the advancing shaft member 28 and the second milling drill bit member 26 once the up-hole orientation key-way 50 is drilled and drilled in communication with the longitudinal window 20. This "no go" member 27 also provides a positive signal to the operator above when the "no go" member 27 hits the second whip stock member 22 that the operation is complete thus providing a positive and easy means of operation for the operator and a clear indication that the up hole key-way 50 is completed and is in communication with the longitudinal window 20.

It will be appreciated by those skilled in the art after the further discussion and teaching of this invention that the depth of the one guide surface 25 on the second whip stock member 22 must be of sufficient length to allow the progression of the second milling drill bit member 26 advance by the advancing drill shaft 28 to go from a protected position out of the way when it is being run into the tubular walls or casing 11 to a length sufficient to fully mill the up hole orientation key-way 50. Further that the depth of the one guide surface 25 on the second whip stock 22 would have a depth from the tubular walls 11 sufficient to protect the second milling drill bit member 26 while being run into the tubular walls or casing 11 to a depth which would put the full diameter of the second milling drill bit member 26 through the tubular walls or casing 11 in order to drill a full gauge and clear up-hole orientation key way. Also as those skilled in the art will appreciate the progression from no engagement by the second milling drill bit member 26 with the tubular walls or casing 11 as the second milling drill bit member 26 is advanced by the advancing shaft 28 down hole, should be only sufficient to provide the second milling drill bit member 26 to engage in the cutting process and not cause it to bind or break, but it should be sufficiently engaged to properly cut the up-hole orientation key-way 50 to full gauge and in complete communication with the longitudinal window 20. Those skilled in the art will now appreciate that this would require some trial and error experimentation depending on their desired up-hole orientation key-way size desired and the types of material and second milling drill bit member 26 used and the thickness of the tubular walls or casing 11, but this experimentation would still not be a departure from the teaching and/or claims of this invention.

In yet other embodiments of this invention releasable locking members 29 may be used on the drill shaft 28 to prevent inadvertent advancement of drill shaft 28 and the second milling drill bit member 26 until these releasable locking members 29 are actuated. In some embodiments these releasable locking member 29 could be rachet thread, not shown, located on the drill shaft 28 with a corresponding set of rachet threads, not shown, located in the locking collar 32 used to attach the drill shaft 28 to the second whip stock member 22.

In yet another embodiment a down hole orientation key-way 51 in communication with the longitudinal window 20 may be milled down hole by using a first whip stock 10 having a second guide surface 33 positioned along the center line of the one guide surface 18. In this embodiment a milling drill bit housing member 34 which has an orientation and positioning surface 36 along one side and a second drill bit 35 connected to it, as shown in FIGS. 13,14, 15, 16 & 17 is lowered into the well for the orientation and positioning surface 36 to progress into sliding engagement with the first whip stock 10 having the inclined surface 17. Once the orientation and positioning surface 36 and inclined surface 17 are aligned additional pressure is applied to the milling drill bit housing member 34 for driving a shim collar 37 upward once the shim collar 37 hits the leading edge 38 of first whip stock 10. Once this shim collar 37 is engaged with the leading edge 38, the leading edge 38 will drive the shim collar 37 upward as the milling drill bit housing member 34 is moved downward with the additional pressure applied from above. As the shim collar 37 is advanced upward while said milling drill bit housing member 34 is moving downward the shim collar 37 has a shim surface 39 which drives against the back surface 40 of leaf griping members 41, also shown in FIG. 17 B–B', which are driven outward into the surface of the tubular walls or casing 11 to lock the 2nd drilling bit housing member 34 into a releasable locked position mated with the inclined surface 17 of first whip stock 10. It should also be understood that in the process of mating the two surfaces the second drill bit 35 mounted in the milling drill bit housing member 34 would be brought into alignment with the second guide surface 33 for the commencement of the milling of the down hole orientation key-way 51 in communication with the longitudinal window 20.

In at least one embodiment the milling drill bit housing member 34 has a channel 42 which is formed in and passes through the milling drill bit housing member 34 and which on one end 44 is open and on the other end 43 is closed with a locking nut 46 which allows an advancing drilling shaft 45 to be put through for advancing or retracting said advancing drilling shaft 45 through aperture 47 as shown in FIG. 17 A–A'. Also connected to the shaft 45 is attached a "no go" 53 which stops the shaft 45 from advancing further down-hole once the shaft 45 has pushed the second drill bit 35 to mill the downhole orientation key-way to completion. Also in this embodiment while the milling drill bit housing member 34 has a channel 42 there through it, the milling drill bit housing member 34 has had some parts of it machined away for it to leave parts of the channel 42 open on the open end 44. A second drill bit 35 mounted to the milling drill bit housing member 34 is positioned in the channel 42 to allow it to be advanced or retracted for the purpose of drilling a down hole orientation key-way 51 in communication with the longitudinal window 20. The parts of the channel 42 which are open allow the second drill bit 35 to be advanced against the second guide surface 33 as the advancing drilling shaft 45 advances the second drill bit 35 along the parts of channel 42 which are open.

Figure 18:
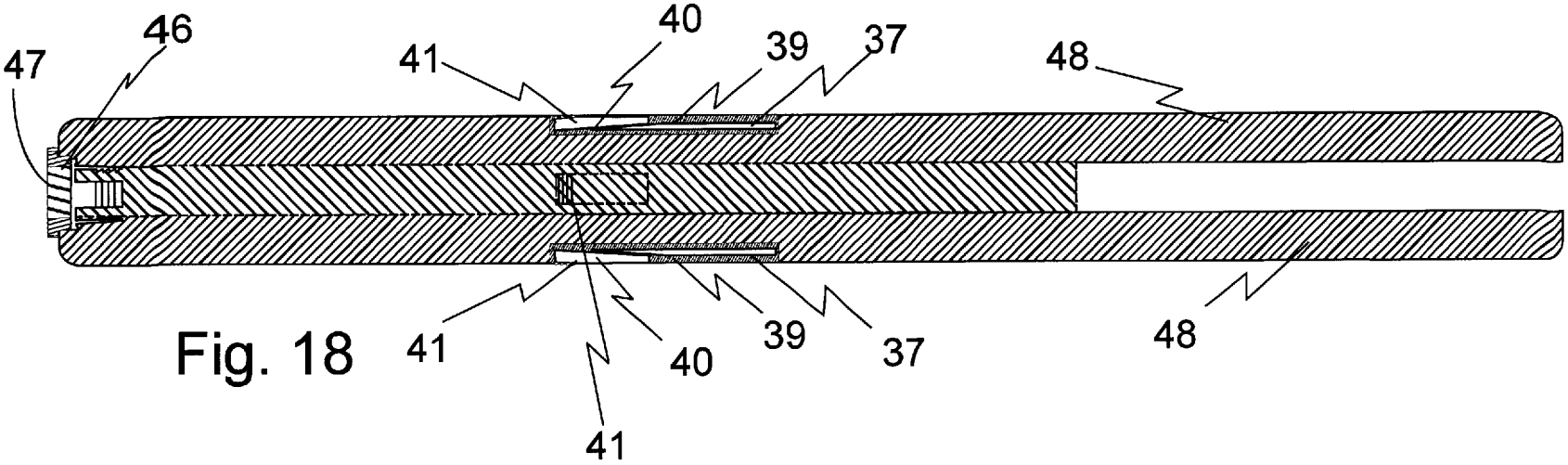
FIG. 18 is a top cross section view of the milling drill bit housing, without the second drill bit member positioned therein, to show the positioning and guiding features of the milling drill bit housing for supporting and guiding the second drill bit means mounted in the milling drill bit housing.
Figure 19:
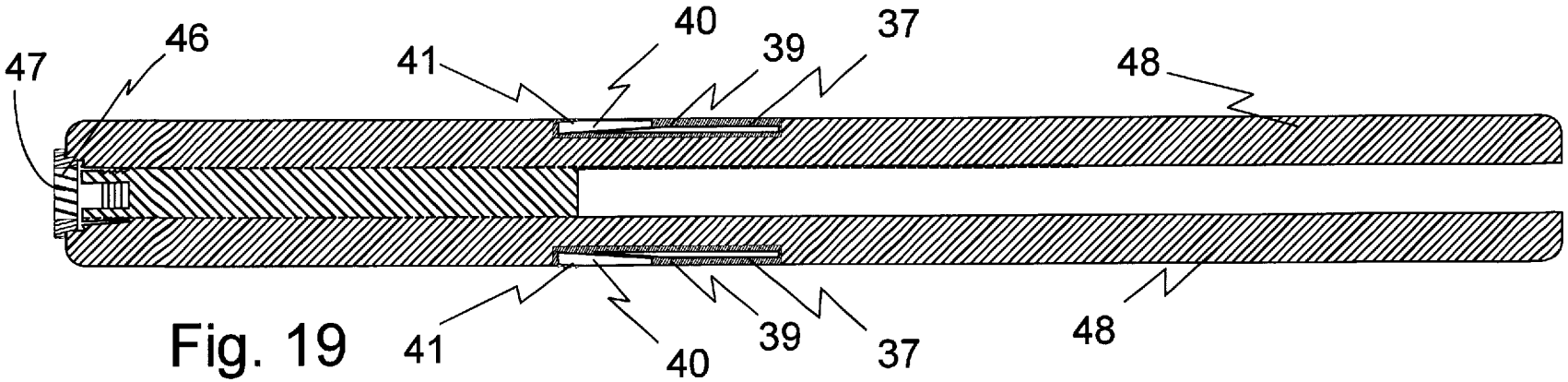
FIG. 19 is a bottom cross section view of the milling drill bit housing, without the second drill bit member positioned therein, to show the positioning and guiding features of the milling drill bit housing for supporting and guiding the second drill bit means mounted in the milling drill bit housing.
Figure 21:
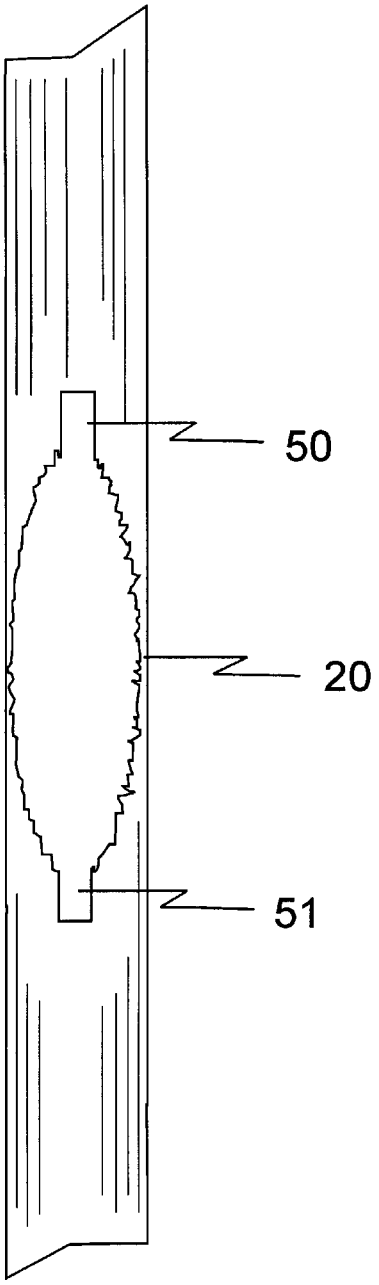
FIG. 21 is a face view of the longitudinal window with both a completed up hole orientation key-way milled and a down hole orientation key-way milled therein in communication with the longitudinal window and showing the first whip stock removed.

The purpose for parts of channel 42 being open can best be understood by referring to FIGS. 17, 18 & 19 without the advancing drill shaft 45 being shown in conjunction with FIGS. 13, 14, 15, & 16 with the advancing drill shaft 45 being shown because in FIGS. 17, 18 ,& 19 it can be seen that the parts of channel 42 which are closed form side guide surfaces 48 along the channel 42. These guide surfaces 48, where the second drill bit 35 and advancing drilling shaft 45 would run, would be on either side of the second guide surface 33 lateral to the second guide surface 33 on the inclined surface 17 of the first whip stock 10. The purpose of these side guide surfaces 48 is to prevent the second drill bit 35 from jumping around and to give accuracy to the milling of the downhole orientation key-way 51 as it is drilled and drilled in communication with the longitudinal window 20.

Figure 13:
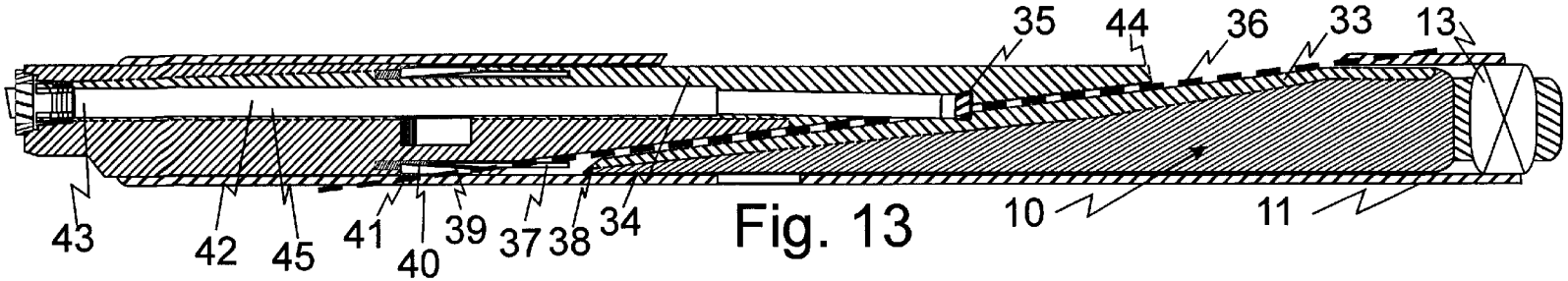
FIG. 13. is a cross section view of the milling drill bit housing for drilling a down hole orientation key-way in communication with a longitudinally milled window in it's sliding mating relationship with a first whip stock having first and second center line guide surfaces.

Referring to FIG., 13 it can be seen how the two members first whip stock 10 with it's inclined surface 17 go into sliding engagement with the second milling drill bit member 26. In FIG. 13, a representational black and white line is used to show the sliding engagement interface. It will also be seen in FIG. 13 that the leading edge 38 of first whip stock 10 has not engaged shim collar 37 to drive the shim surface 39 against the back surfaces 40 of leaf griping members 41 to releasable lock the griping member 41 into the casing 11.

Figure 14:
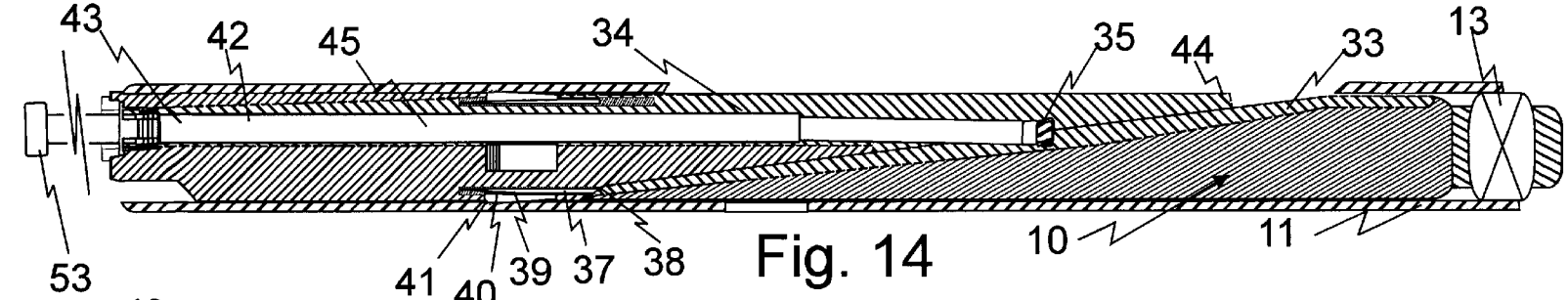
FIG. 14. is a cross section view of the milling drill bit housing for drilling a down hole orientation key-way in communication with a longitudinally milled window with the second drill bit member mounted in the milling drill bit housing in it's starting position for drilling a down hole orientation key-way in communication with the longitudinal window.

In FIG. 14 the leading edge 38 of the first whip stock 10 has engaged the shim collar 37 to drive the shim surface 39 against back surfaces 40 of leaf griping members 41 which drives the leaf griping members 41 into the walls of the tubular walls or casing 11 and provide a positive griping for holding the two member in engagement for the milling operation. Also in the FIG. 14 it can be seen that the beginning position of the second drill bit 35 at the commencement of the milling operation is located in the second guide surface 33, which is located in the center line of one guide surface 18 on the first whip stock 10.

Figure 15:
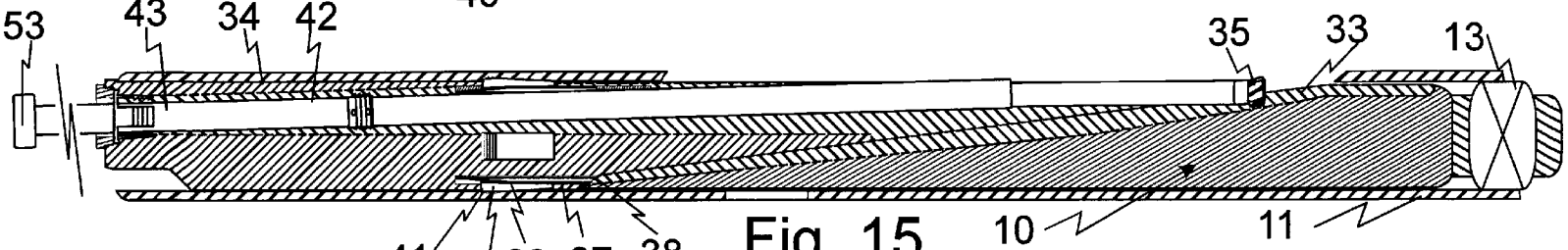
FIG. 15 is a cross section view of the milling drill bit housing for drilling a down hole orientation key-way in communication with a longitudinally milled window in it's mid position as it progresses down the second guide surface positioned along the center line of the first guide surface on the first whip stock for drilling a down hole orientation key-way in communication with the longitudinal window.
Figure 16:
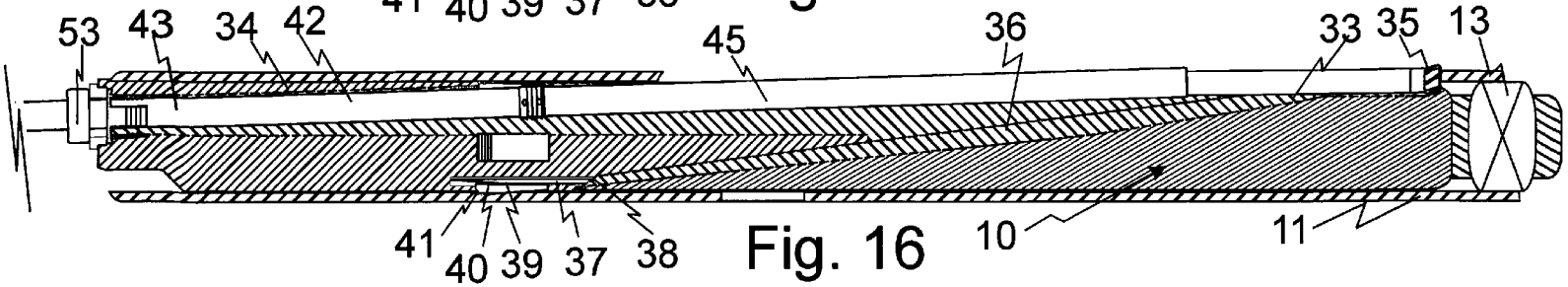
FIG. 16 is a cross section view of the milling drill bit housing for drilling a down hole orientation key-way in communication with a longitudinally milled window in it's finished position as it progresses down the second guide surface positioned along the center line of the first guide surface on the first whip stock for drilling a down hole orientation key-way in communication with the longitudinal window.

In FIG. 15 it can bee seen that the advancing drilling shaft 45 and the second drill bit 35 have advanced down the second guide surface 33 on the whip stock 10. Then in FIG. 16 the advancing drilling shaft 45 and second drill bit 35 would have advanced from no engagement with the casing 11 to engagement with the casing 11 sufficient to mill the down hole orientation key-way 51 to its full gauge and in communication with the longitudinal window 20. It will be appreciated by those skilled in the art that the second guide surface 33 must be deep enough to allow second drill bit 35 to commence a gradual cutting of the tubular walls and casing 11 but not so shallow as to cause it to pass outside the tubular walls and casing 11. Further second guide surface 33 must not be so deep as to only drill out part of the material of the tubular walls or casing 11, which would form an incomplete key-way not of full gauge or size. It should also be noted that the advancing drilling shaft 45 has a camper along it which would also tend to hold it into the second guide surface 33 as it progress in the milling operation.

In FIGS. 17, 18, 19 the advancing drilling shaft 45 is not shown for the purpose of better showing the additional supporting members side guide surface 48 which also help in holding the second drill bit 35 into proper alignment in the drilling process. More particularly in referring to FIG. 18 it can be seen that the channel 42 in conjunction with the side guide surfaces 48 help hold the second drill bit 35, not shown, in proper alignment. In FIG. 19 it can be seen that channel 42 would allow the second drill bit 35, not shown, to engage the second guide surface 33 on whip stock 10 as early as possible so it can follow the second guide surface 33 and yet have the side guide surfaces 48 on either side of second guide surface 33.

Figure 20:
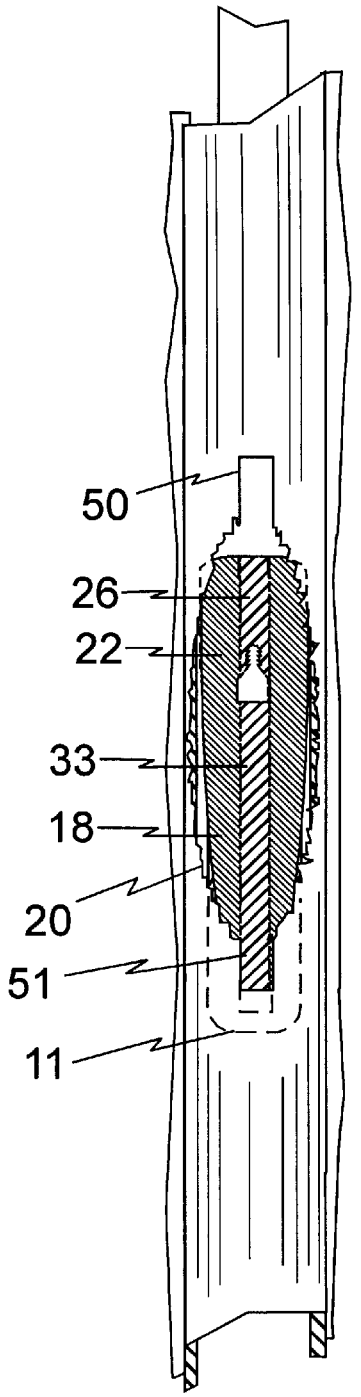
FIG. 20. is a face view of the longitudinal window with both a completed up hole orientation key way milled and a down hole orientation key-way milled therein and showing the first whip stock means still in place.

FIG. 20 shows the end results of the milling of the longitudinal window 20 and the up hole orientation key-way 50 and the down hole orientation key-way 51, which would put this well in condition to either drill a multilateral or reenter a multilateral for workover or any other purpose, using the longitudinal window 20 with the respective orientation key-way 50 and 51 either in combination or individually in the process of accurately locating the longitudinal window 20 for multilateral operations.

While the preferred embodiments of the invention and the methods of their use have been described for the assembly for providing a means of milling windows and key-ways down hole for drilling at least one multi-lateral well from a well bore in a well having tubular walls and for providing a means for entry and reentry into and through the longitudinally window and their use, it will be appreciated that other embodiments and methods may be used without departing from the spirit of the invention.

I claim:

1. A down hole assembly for providing a means of support and positioning for drilling at least one longitudinal window and at least one key-way in communication with said at least one longitudinal window in a tubular wall to be used in drilling multi-lateral well bores and entry and reentry thereafter comprising, a first milling drill bit means for milling at least one longitudinal window, at least a first whip stock means, an orientation and positioning means located on said at least first whip stock means for orientating and positioning tools to be used in drilling and milling at least one key-way in communication with said at least one longitudinal window, at least one guide surface means on said at least first whip stock means for guiding said first milling drill bit means for milling a longitudinal window, a removable platform means for being set in the tubular walls of a well and for supporting said first whip stock means, and an orientation means positioned on said removable platform means for orientation of said at least first whip stock means, said at least one guide surface means, and said orientation and positioning means in the desired direction for milling at least one longitudinally window and at least one key-way which is in communication with said longitudinally milled window.

2. The down hole assembly for providing a means of support and positioning for drilling at least one longitudinal window and at least one key-way in communication with said at least one longitudinal window in a tubular wall to be used in drilling multi-lateral well bores and entry and reentry wherein said orientation and positioning means located on said at least first whip stock means as in claim 1 further comprises, an inclined surface means on said first whip stock means and, a securing means on said first whip stock means.

3. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 2 further comprising, a second whip stock means, at least a second milling drill bit means for drilling an up hole orientation key-way in communication with said longitudinally milled window.

at least one guide surface means on said at least second whip stock means for guiding said at least second milling drill bit means for milling said up hole orientation key-way in communication with said longitudinal window, and a key tool means mounted on said second whip stock means for engagement with said securing means on said at least first whip stock means and for orientation and positioning of said second whip stock means for drilling and milling an up hole orientation key -way in communication with said milled longitudinal window.

4. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 3 wherein said at least one guide surface means on said at least second whip stock means further comprises, a guide means located along the center line of said second whip stock means for guiding said second milling drill bit means for drilling an up hole key way means in communication with said longitudinal window.

5. A down hole assembly for providing a means of support and positioning for drilling at least one longitudinal window and at least one key-way in communication with said at least one longitudinal window in a tubular wall to be used in drilling multi-lateral well bores and entry and reentry thereafter of claim 4 wherein said second whip stock means further comprises, a drill shaft means for up hole and down hole movement, a second drill bit means connected and located on said drill shaft means for drilling said at least one up hole key-way in communication with said at least one longitudinal window in a tubular wall and for acting as a no go in an up hole directional movement of said drill shaft means for selective removal of said first whip stock means, and second whip stock means from said tubular walls of a well, an axle channel means for guiding said second drill bit means as said second drill bit means is rotated therein, a housing means for holding and allowing up and down hole movement of said drill shaft means therein and for providing both an up hole and down hole stopping surfaces for said drill shaft means, and a "no go" means connected and located on a portion of said drill shaft means up hole of said housing means for stopping against said up hole housing means stopping surface when a sufficient distance of travel has occurred for said second drill bit means to cut at least one key-way in communication with said at least one longitudinal window.

6. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 5 wherein said one guide surface means along the center line of said second whipstock means further comprises a channel means for positioning said second milling drill bit means to mill said at least one up hole key-way in communication with said at least one longitudinal window.

7. A down hole assembly for providing a means of support and positioning for drilling at least one longitudinal window and at least one key-way in communication with said at least one longitudinal window in a tubular wall to be used in drilling multi-lateral well bores and entry and reentry thereafter of claim 6 wherein said channel means further comprises varied depths from depths relative to said tubular walls which produce no contact with said tubular walls and said second drill bit means at the start of said second drill bit means operation to depths just sufficient for said second milling drill bit means to mill an up hole orientation key-way in communication with said at least one longitudinal window.

8. A down hole assembly for providing a means of support and positioning for drilling at least one longitudinal window and at least one key-way in communication with said at least one longitudinal window in a tubular wall to be used in drilling multi-lateral well bores and entry and reentry thereafter of claim 7 further comprising, releasable locking means located on said drill shaft means and releasable locking means located in said housing means for releasably locking engagement with said releasable locking means located on said drill shaft means upon movement by said drill shaft means into or out of said housing.

9. A down hole assembly for providing a means of support and positioning for drilling at least one longitudinal window and at least one key-way in communication with said at least one longitudinal window in a tubular wall to be used in drilling multi-lateral well bores and entry and reentry thereafter of claim 8 wherein said a key tool means mounted on said second whip stock means further comprises, a key, and a spring for driving said key out into engagement with said securing means located on said at least first whip stock means.

10. The down hole assembly for providing a means of support and positioning for drilling at least one longitudinal window and at least one key-way in communication with said at least one longitudinal window in a tubular wall to be used in drilling multi-lateral well bores and entry and reentry thereafter of claim 9 wherein said key further comprises releasable locking means located on said key for releasably locking into said securing means located on said at least first whip stock means securely enough to allow removal of said first whip stock means when said second whip stock and key means are pulled from the well.

11. A down hole assembly for providing a means of support and positioning for drilling at least one longitudinal window and at least one key-way in communication with said at least one longitudinal window in a tubular wall to be used in drilling multi-lateral well bores and entry and reentry thereafter of claim 9 wherein said securing means located on said at least first whip stock means further comprises an open key receiving area means, an up hole key locking channel means in communication with said open key receiving area means, and releasable locking means located along said up hole key locking channel means for receiving said releasable locking means located on said key and for locking said key in said up hole key locking channel means.

12. A down hole assembly for providing a means of support and positioning for drilling at least one longitudinal window and at least one key-way in communication with said at least one longitudinal window in a tubular wall to be used in drilling multi-lateral well bores and entry and reentry thereafter of claim 2 further comprising, a milling drill bit housing means, a second drill bit means mounted in said milling drill bit housing means for drilling a down hole orientation key-way in communication with said longitudinally milled window, a second guide surface means positioned along the center line of said at least one surface guide means on said first whip stock means for guiding said second drill bit means to drill a down hole orientation key-way in communication with said longitudinal window, and a orientation and positioning surface means on said milling drill bit housing means for slidable mating with said inclined surface means located on said at least first whip stock means for orientating and positioning said milling drill bit housing means to be used in drilling and milling at least one key-way in communication with said at least one longitudinal window.

13. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 12 further comprising, a drill shaft means mounted on said milling drill bit housing means for up and down hole movement, said second drill bit means connected and located on said second drill shaft means for drilling said at least one down hole key-way in communication with said at least one longitudinal window in said tubular wall, and an axle channel formed in said milling drill bit housing means for guiding said second drill bit means as said second drill bit means is advanced and rotated for drilling said down hole orientation key-way.

14. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 13 wherein said milling drill bit housing means further comprises, at least two guide surface means which when said milling drill bit housing means is in slidable mating engagement with said inclined surface means located on said at least first whip stock means said at least two guide surface means are positioned for guiding said second milling drill bit means.

15. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 14 wherein said milling drill bit housing means further comprises, releasable locking means mounted about said milling drill bit housing means for releasably securing said milling drill bit housing means against movement while said second milling drill bit means is drilling said downhole orientation key-way, and actuator means for actuating said releasable locking means when said orientation and positioning surface means on said milling drill bit housing means goes into slidable mating engagement with said orientation and position means located on said at least first whip stock means.

16. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 15 wherein said second guide surface means positioned along the center line of said at least one surface guide means on said first whip stock means further comprises, a channel means for positioning and guiding said second milling drill bit means to mill said down hole orientation key-way.

17. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 16 wherein said channel means further comprises, a channel having sufficient slope and depth in said channel means relative to said tubular wall of said well for allowing said second milling bit means to mill said downhole orientation key-way means and mill said downhole orientation key-way in communication with said longitudinal window.

18. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 17 further comprising, releasable locking means located on said second drill shaft means and releasable locking means located in said milling drill bit housing means for locking engagement with said releasable locking means located on said second drill shaft means.

19. A down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 18 further comprising, a "no go" means connected and located on said second drill shaft means for stopping against said milling drill bit housing means when a sufficient distance of travel for said second drill bit means has allowed said second drill bit means to cut at least one down hole orientation key-way in communication with said at least one longitudinal window.

20. A method for using a down hole assembly for providing a means of support and positioning for drilling at least one longitudinal window and at least one key-way in communication with said at least one longitudinal window in a tubular wall to be used in drilling multi-lateral well bores and entry and reentry thereafter comprising, setting a packer means having an orientation means in a desired orientation for drilling a multilateral well, orientating a first whipstock means in relation to said orientation means located there below, milling at least one longitudinal window off said whipstock, running a down hole mill assembly means down hole until it no goes with said first whip stock means, activating a second drill bit means for drilling a down hole orientation key-way, and drilling at least one downhole key-way with said second drill bit until it is in communication with said at least one longitudinal window.

21. A method for using a down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 20 further comprising, running a second whip stock means down hole which has attached thereto through a housing at least a second milling drill bit means, setting said second whip stock means using a key tool means on said second whipstock means to mate with said first whipstock means, and drilling at least one up hole orientation key-way until it is in communication with said at least one longitudinal window.

22. A method for using a down hole assembly for providing a means of support and positioning for drilling at least one longitudinal window and at least one key-way in communication with said at least one longitudinal window in a tubular wall to be used in drilling multi-lateral well bores and entry and reentry thereafter as in claim 21 further comprising the steps of, activating said at least second milling drill bit means to rotation, advancing said at least second milling drill bit means down hole in at least one guide surface means for control of said at least second milling drill bit means precise direction, controlling the depth of drilling of said at least second milling drill bit means relative to said tubular walls of a well for drilling a full gauge orientation key-way in communication with said longitudinal window, stopping said at least second milling drill bit means advance down hole by a no go means, and pulling said at least second milling drill bit means up hole against said housing for no go against to allow said second whip stock means and said first whip stock means to be retrieved from the well after milling of at least one longitudinal window and at least one orientation key-way in communication with said at least one longitudinal window.

* * * * *